United States Patent [19]

Frezza

[11] 4,174,101

[45] Nov. 13, 1979

[54] HIGH SPEED HORIZONTAL FOLDER

[75] Inventor: Robert Frezza, Carle Place, N.Y.

[73] Assignee: Samcoe Holding Corporation, Woodside, N.Y.

[21] Appl. No.: 866,487

[22] Filed: Jan. 3, 1978

[51] Int. Cl.[2] ..... B65H 45/20

[52] U.S. Cl. ..... 270/79

[58] Field of Search ..... 270/79, 61 F, 30–31

[56] References Cited

U.S. PATENT DOCUMENTS

| | | | |
|---|---|---|---|
| 1,832,557 | 11/1931 | Jensen | 270/79 |
| 2,761,678 | 9/1956 | Cohn | 270/79 |
| 3,109,643 | 11/1963 | Zimmerman | 270/79 |
| 3,165,311 | 1/1965 | Mitchell | 270/79 |
| 4,074,901 | 2/1978 | Catallo | 270/79 |

*Primary Examiner*—Edgar S. Burr
*Assistant Examiner*—A Heinz
*Attorney, Agent, or Firm*—Mandeville and Schweitzer

[57] ABSTRACT

The disclosure relates to a mechanism for high speed horizontal folding of fabrics, such as tubular knitted fabrics, enabling the fabric to be folded at greatly increased linear speed in relation to the prior art. The folder apparatus includes horizontally reciprocating downfeed rollers which receive the incoming fabric and propel it downwardly, while guiding the fabric horizontally to lay it in back and forth folds of substantially uniform length. Means are provided for reciprocating the downfeed rollers horizontally at high speed during the folding operation. Means are also provided for continuously rotating the downfeed rollers, independently of the horizontal reciprocating motion thereof, for directing the incoming fabric downward toward the accumulating fold stack. Reciprocating weight is held at a minimum by providing a novel external drive for the downfeed rollers, which are operative to provide a constant rate of downfeed of the fabric in any horizontal position of the downfeed rollers. The invention also provides an optimum geometrical condition for the incoming fabric web, for minimizing the effects of air inertia and resistance on the rapidly oscillating fabric web.

In accordance with still another feature of the invention, an advantageous arrangement of counterweights is provided. The means for reciprocating the downfeed rollers are also connected to the counterweights for reciprocation 180° out of phase with the reciprocating motion of the downfeed rollers to effectively balance the inertia thereof.

13 Claims, 5 Drawing Figures

HIGH SPEED HORIZONTAL FOLDER

SUMMARY AND BACKGROUND OF THE INVENTION

In the processing of fabrics, including but not limited to tubular knitted fabrics, finished or substantially finished fabric typically is gathered by rolling or folding. An advantageous form of fabric folding equipment, known in the past, is reflected in the Eugene Cohn U.S. Pat. No. 2,761,678, assigned to Samcoe Holding Corporation. In the apparatus of that patent, finished fabric is directed upward from the finishing equipment and is passed over a driven infeed roller. The fabric then is directed generally downward, between a pair of downfeed rollers, which are constantly reciprocated back and forth over a receiving platform. As the fabric is guided repetitively back and forth, it gathers on the platform in folded layers of relatively uniform length.

In the course of development of the fabric finishing art, constant improvements have been made in the linear speed at which it is possible to perform processing operations, to the point where processing of tubular knitted fabric, for example, may now be carried out at speeds in excess of one hundred fifty yards per minute. Heretofore, however, where the mill procedure has dictated gathering of the finished fabric by folding, the folding operation itself has served to limit the processing speed, because of the practical difficulties involved in folding a wide web of fabric at such high speeds. As can be readily appreciated, when attempting to reciprocate a web of fabric back and forth at high speed, there can be substantial resistance from the air to lateral movement of the web (sailing effect). In accordance with the present invention, a novel and improved horizontal folder arrangement is provided which minimizes and controls to an optimum extent sailing of the fabric during high speed folding movements. Additionally, when folding at high speed, constant, uniform downfeeding of the fabric is important, as any variations therein can substantially affect the uniformity of the folding operation.

In accordance with one of the significant aspects of the invention, a novel and improved arrangement is provided for constantly driving the downfeed rollers of a horizontal folding apparatus, to achieve substantially uniform downfeeding of the fabric, yet which is wholly consistent with high speed horizontal reciprocation of the rolls. To this end, a first drive arrangement is provided for reciprocating the downfeed rollers horizontally back and forth over the receiving platform, and an independent drive arrangement is provided for rotating the downfeed rollers, in order to maintain the rollers in continuous rotation, even at the ends of the reciprocating motion of the roll carriage.

Pursuant to another feature of the invention, in order to minimize reciprocating weight of the carriage and support mechanisms for the downfeed rollers, the independent drive means for the downfeed rollers is arranged for stationary mounting, and engages and drives the downfeed rollers through an endless belt or the like, which extends alongside the reciprocating path of the roll carriage. In conjunction therewith, novel arrangements are provided for effectively compensating for the fact that, during a portion of its cycle, the roll carriage is moving with the endless belt and, during the other portion of its cycle, the roll carriage is moving opposite to the belt. The arrangement of the invention takes advantage of the windage and inertia of downwardly feeding fabric is to cause the fabric to be driven by one roller, when the carriage is moving in one direction, and by the other roller when the carriage is moving in the opposite direction. Accordingly, arrangements are made for the respective rollers to be driven at different speeds relative to each other, to the end that the fabric feed is substantially constant speed in both directions of reciprocating travel of the roll carriage.

In order to accommodate adequately high speed reciprocating movement of the downfeed roller carriage, the apparatus of the invention includes a simplified and advantageous arrangement of counterweights, which move oppositely to the downfeed roller carriage, in order to achieve a balance of acceleration and deceleration forces at the ends of the reciprocating strokes.

For a more complete understanding of the above and other features and advantages of the invention, reference should be made to the following detailed description of a preferred embodiment and to the accompanying drawings.

DESCRIPTION OF A PREFERRED EMBODIMENT OF THE INVENTION

Figure 1:
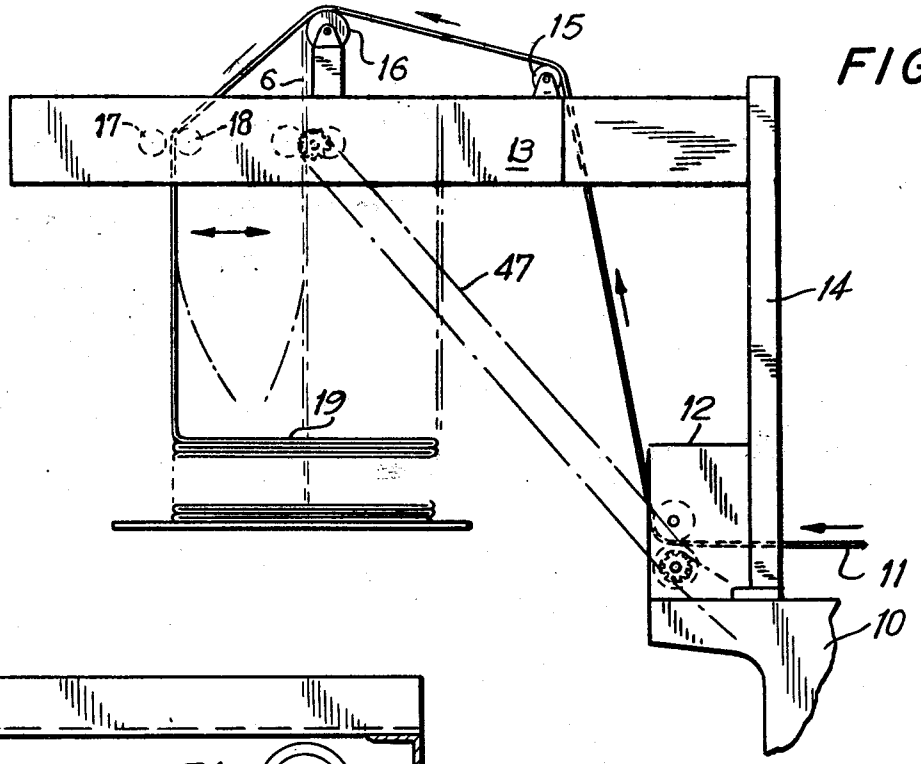
FIG. 1 is a fragmentary side elevational view of a finishing line for web material, such as tubular knitted fabric, incorporating a high speed horizontal folder according to the invention.

Referring now to the drawings, and initially to FIG. 1 thereof, the reference numeral 10 designates in a general way the discharge end of a fabric processing line which may, for the purposes of example, be a padding apparatus for the liquid processing of tubular knitted fabric. The processed fabric 11, in smooth flat form and at a uniform width, passes about a guide roller 12 and is directed upwardly to the folding mechanism. A folding mechanism, generally designated by the numeral 13, is appropriately mounted in relation to the processing line 10, and in many cases may be mounted directly thereon, as by means of a supporting structure 14. The folding mechanism 13 includes a guide roller 15, which receives the upwardly directed fabric 11, and a reference guide roller 16. Some or all of the guide rollers 12, 15, 16 may be driven, and desirably at least the reference guide roller 16 is driven and has a high friction surface capable of maintaining an adequate driving contact with the fabric 11 passing over the top of it.

With reference still to FIG. 1, the fabric 11 passing over the reference guide roller 16, is directed generally downward, between a pair of downfeed rollers 17, 18, which, by means to be described, are reciprocated horizontally between limit positions reflected in FIG. 1. Fabric being discharged from the finishing line 10 is conveyed upwardly, over the guide rollers 15, 16 and thence downwardly through the downfeed rollers 17, 18. In accordance with known general procedures, the downfeed rollers reciprocate horizontally at a linear speed corresponding to the linear rate of discharge of fabric from the processing line. This enables the fabric to be laid back and forth in a uniform stack 19.

As output speeds of the processing line 10 have been progressively increased with periodic improvements, the matter of maintaining adequate uniformity in the folded stack 19 has become increasingly troublesome. The web of finished fabric 11 may have considerable width and, in addition, may have relatively low weight per unit in area. Thus, when reciprocated at high speeds, there is a tendency for the fabric to "sail", with accompanying loss of control. In addition, at increasingly higher speeds, the matter of maintaining a constant, uniform, controlled movement of the fabric becomes increasingly critical.

In the apparatus of the invention, the folding mechanism 13 includes a pair of spaced side frames 20, 21 rigidly connected by structural members 22, 23 located near the ends of the side frames so as to form a central "window" 24. The length and width of the window 24 are appropriate for the maximum web of fabric 11 to be accommodated and for the length of the horizontal reciprocating stroke of the folding mechanism. This enables the fabric to pass downwardly to the window 24 during the folding sequence.

Figure 5:
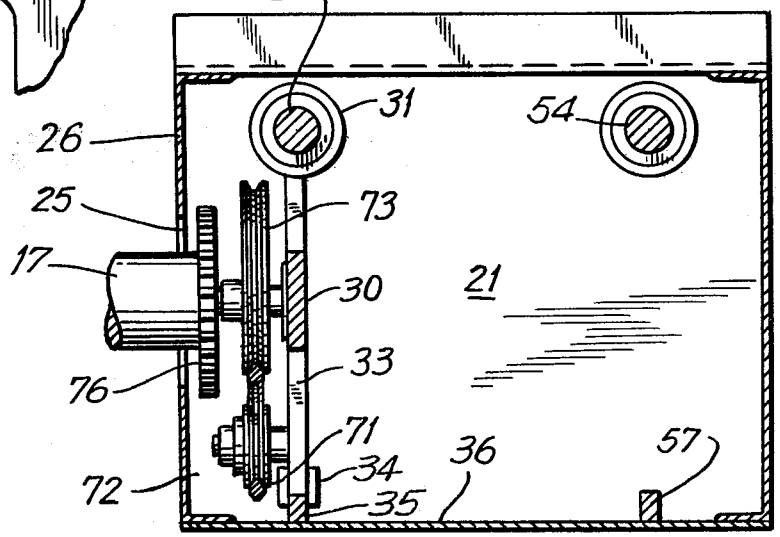
FIGS. 4 and 5 are enlarged, cross sectional views, as taken generally on lines 4—4, 5—5 respectively of FIG. 3.
Figure 4:
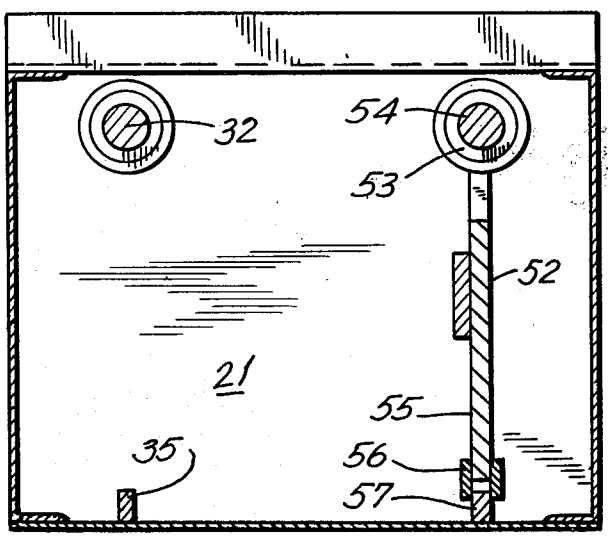

The respective downfeed rollers 17, 18 extend the full width of the window opening 24 and are received at their ends in horizontally elongated slots 25 formed in the inner side walls 26 of the respective side frames. The downfeed rollers 17, 18 are carried by shafts 27, 28 journaled and supported by carriage yokes 29, 30 at each side. As reflected in FIGS. 3 and 5, the carriage yokes are secured to spaced bearing sleeves 31, which are slideably received on elongated guide rods 32 at each side. Each of the carriage yokes 29, 30 has a downwardly extending stabilizing arm 33, having side plates 34 arranged in straddlling relation to a guide rail 35 mounted on the lower wall 36 of the side frame structure. The carriage yokes 29, 30, which are of relatively lightweight construction, are arranged to reciprocate longitudinally along the respective guide rods 32, to effect the desired horizontal reciprocation of the downfeed rollers 17, 18.

Reciprocating motion of the downfeed roll carriage, comprising the carriage yokes 29, 30 and the rolls 17, 18, is accomplished by means of chains 37, 38, which are trained about sprockets 39, 40 and 41, 42 respectively. These sprockets are mounted on shafts 43–46 respectively supported in the structure of the side frames 20, 21. One of the sprocket shafts, advantageously the shaft 46, is driven in synchronism with the finishing line 10, as by means of a chain 47 (FIG. 3) driving a sprocket 48. The chains 37, 38 at opposite sides are interconnected for synchronous movement. This may be accomplished by any suitable means as for example by interconnecting of sprockets 49, 50 on the respective shafts 46, 44, through the intermediary of the reference guide roler 16. The guide roller itself is driven in predetermined synchronism with the horizontal reciprocating movements of the roll carriage by a chain 61.

Crank linkages 51 at each side connect the respective chains 37, 38 to the carriage yokes 29, 30. Accordingly, as the chains are unidirectionally driven, the carriage yokes are reciprocated in unison, being driven at a uniform speed substantially end to end, but also being more or less sinusoidally decelerated and accelerated at the stroke ends.

Notwithstanding the relatively lightweight construction of the carrage members 29, 30, and of the downfeed rollers 17, 18, which may be of hollow construction, the reciprocating mass of the downfeed roll carriage is significant at the folding speeds contemplated by the present invention. Accordingly, means are provided for counterbalancing the inertia variations at the opposite ends of the reciprocating stroke. For this purpose, counterweighting plates 52 are provided at each side, being slideably supported by bearing sleeves 53 on longitudinal guide rods 54 arranged parallel to but outside of the carriage guide rods 32. The counterweight plates have portions 55 extending toward the bottom of the side structures 21, 22, and these are provided with guide plates 56 straddling an elongated guide rail 57. Opposite side chains 58, 59 are driven by sprockets 60 carried by the respective shafts 43–46.

Pursuant to the invention, the counterweight plates 52 are arranged for movement in unison, back and forth along the guide rods 54, in direct opposition to the back and forth movement of the roll carriage 29, 30. This is accomplished by providing a crank linkage, such as the type indicated at 51 in FIG. 2, to connect the respective chains 58, 59 to the plates 52 exactly 180° out of phase with the downfeed roll carriage. As will be appreciated, the moving weight of the counterweight system is ideally exactly equal to the moving weight of the roll carriage, so that inertia variations in one of the units, at the end of its stroke, will be effectively balanced out within the drive system and will not be transmitted to the supporting structure. The particular structural arrangement shown provides for the necessary counterbalancing in a simplified, yet highly effective manner.

In the apparatus of the invention, the rate of delivery of fabric by the folding apparatus is controlled primarily by the reference guide roller 16, which is driven in synchronism with the output of the processing line 10. Synchronous driving may be accomplished by means of a direct power take off, as reflected by the chain 47 in FIG. 1, or by means of a separate drive system controlled by a dancer roll or other means for maintaining speed synchronism. In the past, in prior art apparatus such as reflected in the Cohn U.S. Pat. No. 2,761,678, for example, the downfeed rollers 17, 18, which receive fabric from the reference guide roller 16, have been driven by a rolling action derived from the horizontal reciprocation thereof. Because of the high linear speeds required of the equipment of the invention, such arrangements for driving the downfeed rollers are not adequate, because of the momentary deceleration and stoppage of rotation of the downfeed rollers at each end of the reciprocating stroke. At high linear fabric speeds, even a momentary stoppage of the downfeed rollers would cause undesirable irregularities in the smooth movement of the fabric, and could also cause excessive accumulations of slack fabric between the constantly moving reference guide roller 16 and the momentarily stopped downfeed rollers. Accordingly, in the apparatus of the invention, a continuous drive arrangement is provided for the downfeed rollers, such that the rollers continue to be rotated even when the horizontal movement thereof is momentarily stopped at the extremities of the reciprocating stroke.

Figure 2:
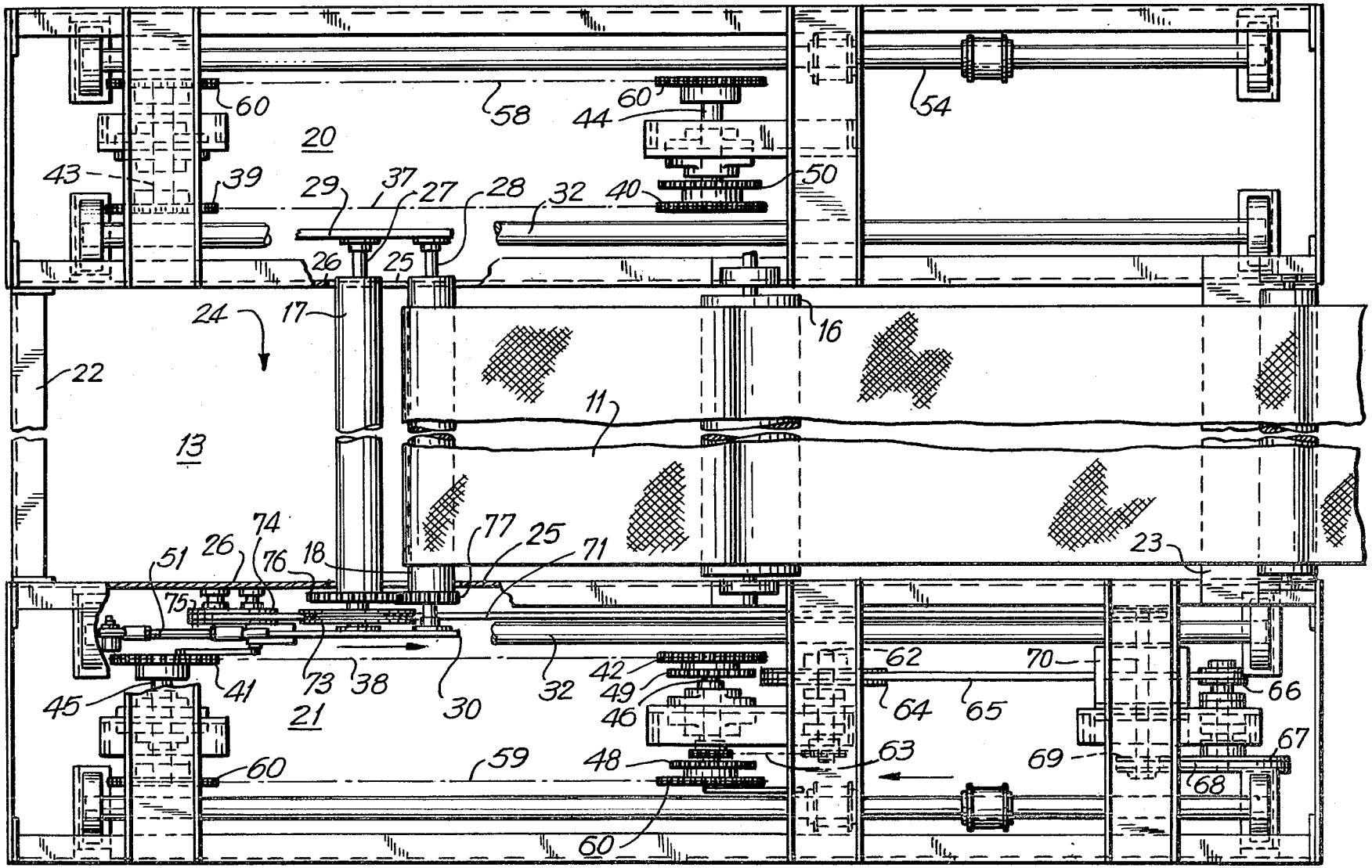
FIG. 2 is a top plan view, partly broken away, of the folding mechanism and drive means as utilized in the apparatus of FIG. 1.
Figure 3:
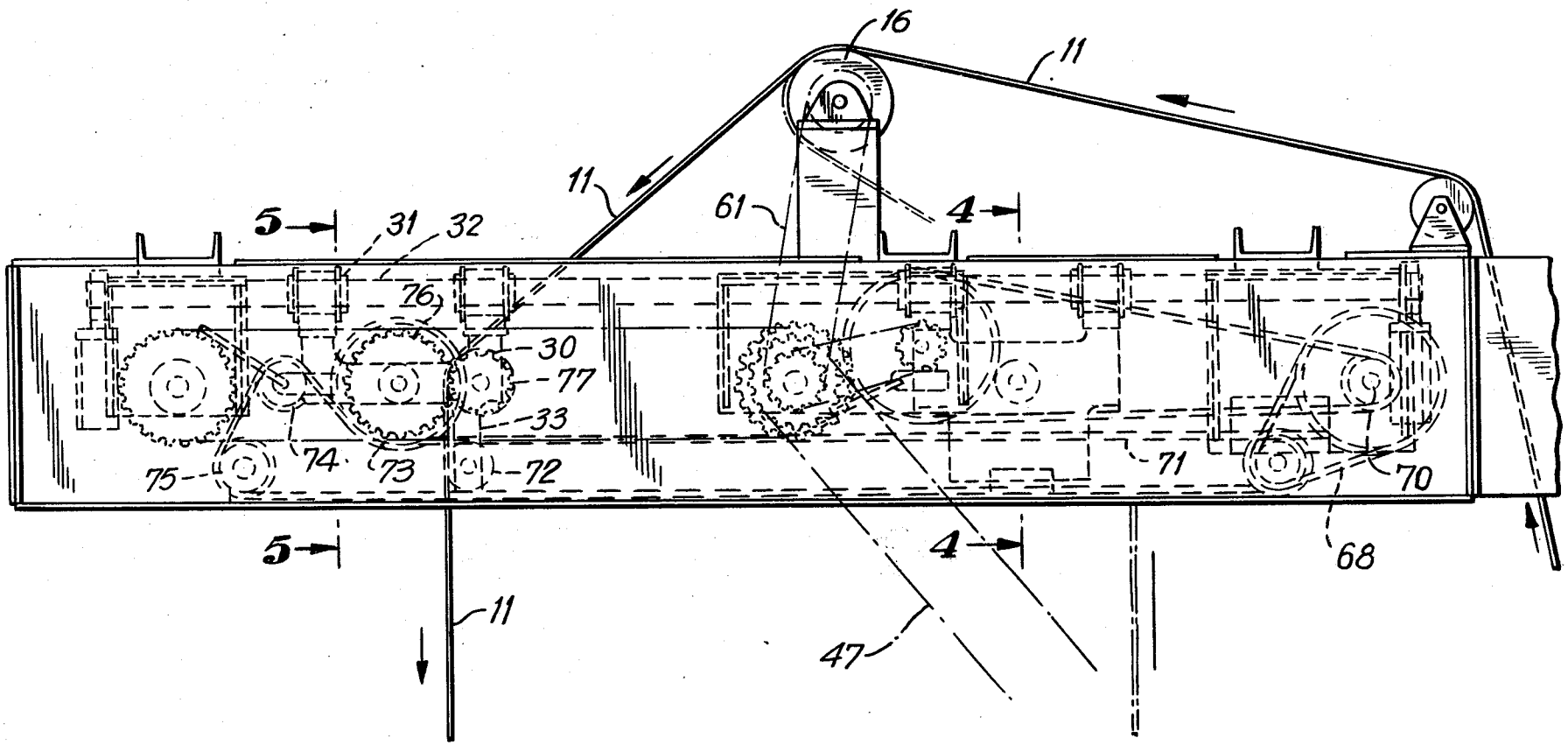
FIG. 3 is a side elevational view of the folding mechanism of FIG. 2.

With reference particularly to FIGS. 2 and 3, the shaft 46, which is being constantly driven, drives a secondary shaft 62, by means of a chain 63. Through a system of pulleys and belts 64–69, a shaft 70 is rotated to drive an endless belt 71, forming the drive input for the downfeed rollers 17, 18. The drive input belt 71 is trained at one end around the pulley 69 and at the opposite end around a series of pulleys 72–75 (FIG. 3). The pulley 73 is carried by the downfeed roller 17, and the pulleys 72, 74, on either side thereof, serve to guide the drive belt 71 around a sufficient arc of the pulley 73 to assure effective driving engagement. In this respect, the drive belt 71 is of a symmetrical configuration inside and out, such as circular or diamond configuration, so as to enable effective guiding and driving contact with the outside surface of the belt, as well as the inside.

As viewed in FIG. 3, the belt 71 is driven in a counter-clockwise manner, so that the upper region of the belt is traveling from right to left in FIG. 3, driving the downfeed roller 17 to rotate in a clockwise direction. As will be appreciated, since the drive belt 71 is at all times in motion, the driving action of the belt will be effective upon the downfeed roller 17, even when the latter is stopped at the end of its reciprocating stroke.

With reference to FIG. 3, it will be noted that, with the upper reach of the drive belt 71 moving from right to left, there will be a relative subtractive effect upon the rotation of the downfeed roller 17 when the latter is moving in the same direction as the belt, that is from right to left. Likewise, there will be an additive effect when the reciprocating movement of the rollers is from left to right. Accordingly, the downfeed roller 17 will rotate at one speed when moving from right to left and at a substantially higher speed when moving from left to right. To compensate for this differential, the right-hand downfeed roller 18 is driven by the left-hand downfeed roller 17, through an arrangement of gears 76, 77 calculated to drive the downfeed roller 18 at all times at a speed which is greater than the speed of the roller 17. In this respect, the important relationship is the relative peripheral speeds of the respective downfeed rollers 17, 18, and equivalent arrangements could be made by rotating equal diameter rollers at different speeds or by rotating the respective rollers at the same speeds, where the diameter of the roller 18 is appropriately larger than that of the roller 17. Likewise, a proper differential action may be achieved by a combination of differential speed and diameter.

When the downfeed roller carriage is being reciprocated at high speed, and the carriage is moving from right to left as viewed in FIG. 3, both windage and inertia serve to press the fabric against the right-hand downfeed roller 18 which, as shown in FIG. 2, is spaced slightly from the roller 17. Accordingly, during the right-to-left movement of the roll carriage, it is the roller 18 which controls the downfeeding of the fabric 11. According to the invention, the relatively increased peripheral speed of the downfeed roller 18 is calculated to compensate for the relatively reduced rate at which the rolls are driven during the right-to-left reciprocation, because of the relative subtractive effect of the carriage movement in relation to the movement of the drive belt. Likewise, during the left-to-right reciprocation of the roll carriage, inertia and windage of the fabric, at the reciprocating speeds contemplated, urge the fabric over into driving contact with the left-hand downfeed roller 17 such that, during right-to-left reciprocations, the downfeeding of the fabric 11 is controlled by the relatively slower peripheral speed of the downfeed roller 17, offset by the additive effect of the left-to-right motion of the roll carriage in relation to the right-to-left motion of the belt. The arrangement, according to the invention, is such that the linear rate of downfeeding of the fabric 11 is equal in both reciprocating directions, notwithstanding the fact that the downfeed roller 17 is rotating at a substantially greater rate of speed when reciprocating in one direction than when reciprocating in the other.

Pursuant to another aspect of the invention, an advantageous geometrical relationship is provided between the reciprocating downfeed rollers 17, 18 and the reference guide roller 16, in order to optimize operating conditions for high speed linear movement of the fabric 11. As will be understood by reference to FIG. 3, because of the horizontal displacement of the downfeed rollers 17, 18 from the vertical plane of the reference roller 16 at the end of each reciprocating stroke, there tends to be an accumulation of surplus fabric between the reference roller and the downfeed rollers during the first half of the return movement of the downfeed roller carriage from either of its extreme positions. That is, the fabric is passing between the downfeed rollers at substantially the same linear rate that it is passing over the reference roller 16, but the horizontal distance between the rollers is constantly decreasing during the first half of the reciprocating movement, resulting in an excess of fabric between the rolls and thus a slack condition of the fabric. This slack is of course taken up during the second half of the reciprocating stroke of the roll carriage, when the horizontal distance between the reference roller 16 and the downfeed rollers is increasing. Nevertheless, an excessive amount of slack fabric during the initial half of the reciprocating cycle is undesirable from the standpoint of maintaining effective control over the fabric.

While the amount of slack fabric during the first half of a reciprocating stroke can easily be reduced and minimized by the simple expedient of substantially raising the height of the reference roller 16 in relation to the horizontal plane of reciprocation of the downfeed rollers 17, 18, that expedient creates its own problems with regard to the windage effect upon the fabric. Thus, if the reference roller 16 is raised a substantial distance above the plane of the downfeed rollers, there is a substantial vertical exposure of the fabric web being rapidly reciprocated back and forth. The air resistance on a large area of fabric reciprocating back and forth at the extremely high linear speeds contemplated by the invention (e.g. 150 yards per minute) tends to cause the fabric to "sail", causing problems in maintaining effective control over the fabric. Pursuant to the invention, optimum operating conditions can be realized by so positioning the reference roller 16 as to cause the fabric 11, if stretched taut, to be disposed at an angle of approximately 45° to the reciprocating plane of the downfeed rollers, when the roller carriage is at one extreme or the other of its reciprocating stroke. In this respect, the reference roller 16 is located such that its forward (left-hand in FIG. 3) edge is located approximately midway between the extremes of carriage reciprocation. Because of the diameter of the reference roller 16, the angle between the fabric and the reciprocating plane may be slightly different at one extreme of the stroke, when the fabric is leading from the bottom of the reference roll, then at the other extreme, when the fabric is leading from the top of the reference roll. In either case, the optimum angle is approximately between, say, 35° and 55°, such that the tendencies for the fabric to develop slack and/or to have exceed wind resistance are minimized.

The apparatus of the present invention represents a significant advance in the fabric processing art by enabling fabric webs to be flat folded at linear rates of speed consistent with the high rates at which the fabric can be processed. In this respect, the apparatus of the invention is capable of flat folding wide webs of limp fabric material in an acceptable manner at linear rates up to 150 yards per minute.

In order to maintain a uniform folding pattern and a uniform edge in the folded stack at the high speeds of operation contemplated, a novel arrangement is provided for maintaining continuous driving motion of the downfeed rollers, even during the reversal phase of the reciprocating carriage. Since reciprocating weight is desirably maintained at a minimum, to accommodate the high speed motion of the carriage, driving of the downfeed rollers is accomplished by an external non-reciprocating system, including a continuously driven belt, and novel arrangements are made to compensate for the relative additive and subtractive effects of roller carriage reciprocation in relation to continuous, unidirectional motion of the external drive belt. Thus, one of the downfeed rollers is at all times driven at a relatively greater peripheral speed than the other, and the arrangement of the downfeed rollers is such that the fabric is effectively driven by one of the rollers, when the carriage is moving in one direction, and the other roller, when the carriage is moving in the other direction. The relative speed compensation is such that, in either case, the fabric is driven at a substantially constant speed.

In the system of the invention, fabric is directed to the reciprocating downfeed rollers from a stationary, driven reference roller, located above the downfeed rollers and midway between the extremes of the reciprocating movement thereof. By so locating the reference guide roller that the fabric web leading therefrom to the downfeed rollers, in either extreme position of the latter, makes an angle of around 45° to the plane of reciprocation, the effects of windage on the fabric leading from the reference roller are minimized; at the same time, excessive sag in the fabric, during the initial portion of a reciprocating stroke, is avoided.

The arrangement of the invention also includes relatively simple, economical and yet effective counterweighting arrangements, such that the inertia variations resulting from the reciprocating motion of the downfeed roller carriage are effectively balanced out and isolated within the side frame structures which support and guide the roll carriage.

It should be understood, of course, that the specific form of the invention herein illustrated and described is intended to be representative only, as certain changes may be made therein without departing from the clear teachings of the disclosure. Accordingly, reference should be made to the following appended claims in determining the full scope of the invention.

I claim:

1. A high speed horizontal folder for fabric web material and the like, which comprises (a) a pair of downfeed rollers, (b) reciprocating means for reciprocating said downfeed rollers back and forth over a folding platform at a predetermined rate of reciprocation.

(c) means to deliver the web material in a generally downward direction to said downfeed rollers at a steady rate corresponding to said rate of reciprocation of said downfeed rollers, (d) a drive means to rotatingly drive said downfeed rollers comprising an endless drive element mounted on said folder at a position remote from said reciprocating means and means for driving said element so that at least a portion thereof is advanced unidirectionally at a constant rate corresponding to the rate of delivery of the fabric web, (e) means interconnecting the downfeed rollers to said unidirectionally driven portion of the drive element in any position of the downfeed rollers, whereby said drive element tends to drive the rollers at a faster rotational speed when the rollers are moving in a first direction of a reciprocating stroke and at a slower rotational speed when the rollers are moving in the opposite direction of the reciprocating stroke, and (f) compensating means associated with said interconnecting means and said downfeed rollers providing differential peripheral speeds for the respective downfeed rollers to compensate for the faster and slower rates of speed caused by the relative motion between said unidirectionally moving portion of the drive element and said reciprocating downfeed rollers, thereby providing a uniform rate of delivery of the fabric web by the downfeed rollers.

2. Apparatus according to claim 1, further characterized by (a) one of said downfeed rollers being driven directly by said endless drive element, and (b) the other of said downfeed rollers being driven by said one roller.

3. Apparatus according to claim 2, further characterized by (a) said compensating means including a first gear element mounted on said one roller and a second gear element mounted on said other roller, (b) said first gear element being in a driving engagement with said second gear element, (c) said first and second gear elements being arranged whereby said other roller is driven with a peripheral speed which is greater than the peripheral speed of said one roller.

4. Apparatus according to claim 1, further characterized by (a) said endless drive member comprising a flexible belt-like element extending generally horizontally adjacent one end of said downfeed rollers, (b) said interconnecting means including a pulley on at least one of said downfeed rollers engaging and driven by said belt-like element, and (c) guide roller means associated with said pulley for guiding and diverting said belt-like element around a portion of said pulley.

5. Apparatus according to claim 1, further characterized by (a) side support structures at each end of said downfeed rollers, (b) carriage means movably supported by said side support structure and engaging and supporting said downfeed rollers at each end, (c) an elongated, longitudinally extending guide rod in each of said side support structures, (d) said carriage means being slideably suspended from said guide rods.

6. Apparatus according to claim 5, further characterized by (a) endless carriage drive means in each of said side supports connected to the respective carriages and operative when unidirectionally driven to reciprocate said carriages in unison, (b) a horizontally reciprocating counterweight in each of said side support structures, (c) said counterweights being positioned closely adjacent the outer ends of said downfeed rollers and being guided for reciprocation substantially in the plane of reciprocation of said downfeed rollers, (d) said counterweights being connected to said endless carriage drive means to be driven in oppositely reciprocating relation thereto.

7. A high speed horizontal folder for fabric web material and the like, which comprises (a) a pair of horizontally reciprocating downfeed rollers, (b) downfeed roller carriage means supporting said rollers at each end, (c) means to deliver the web material in a generally downward direction to said downfeed rollers at a predetermined rate of delivery, (d) unidirectionally moving endless carriage drive means for effecting reciprocating movement of said downfeed rollers at a rate substantially equal to said rate of delivery of web material to the folder, (e) a pair of counterweights, one opposite each end of the downfeed rollers, mounted for reciprocation substantially in the reciprocating plane of said downfeed rollers, (f) said counterweights being connected to said unidirectionally moving endless carriage drive means for reciprocation approximately 180° out of phase with the reciprocating motion of said downfeed rollers, whereby the moving weight of said counterweight effectively balances out the inertia of said downfeed roller carriage means, and (g) continuously driven downfeed roller drive means engaging said downfeed rollers in any position for effecting continuous, substantially constant speed rotation thereof during reciprocation thereof.

8. A high speed horizontal folder according to claim 7, further characterized by (a) at least the power source for said downfeed roller drive means being non-reciprocating.

9. A high speed horizontal folder according to claim 8, further characterized by (a) said downfeed roller drive means comprising an endless belt-like element extending generally along the plane of reciprocation of said downfeed rollers.

10. A high speed horizontal folder according to claim 9, further characterized by (a) said belt-like element drivingly engaging one of said downfeed rollers, (b) the other of said downfeed rollers being driven by said one downfeed roller at a differential surface speed relative thereto, and (c) said downfeed rollers being spaced apart such that only one roller at a time has driving contact with said fabric.

11. A high speed horizontal folder according to claim 10, further characterized by (a) a reference guide roller being mounted above said downfeed rollers and midway between the reciprocating limits thereof, (b) said reference guide roller being spaced above said downfeed rollers a distance equal to approximately half the reciprocating stroke of said downfeed rollers.

12. A high speed horizontal folder, according to claim 7, further characterized by (a) said means to deliver the web material including a reference guide means mounted above said downfeed rollers for guiding web material toward the downfeed rollers, (b) said reference guide means being mounted approximately midway between the limits of reciprocation of said downfeed rollers, (c) said reference guide means being mounted at a height above the plane of reciprocation of said downfeed rollers, such that the straight line path from said reference guide means to said downfeed rollers, at the extremities of the reciprocating strokes thereof, is approximately in the range of 35°–55°.

13. A high speed horizontal folder according to claim 12, further characterized by (a) said reference guide means comprising a driven roller.

* * * * *